US007524401B2

(12) United States Patent
Wildfong et al.

(10) Patent No.: US 7,524,401 B2
(45) Date of Patent: Apr. 28, 2009

(54) HYBRID TYPE FORMING SECTION FOR A PAPER MAKING MACHINE

(75) Inventors: Vaughn Wildfong, East Longmeadow, MA (US); Richard Pitt, Almonte (CA); Thomas Helbig, Bernardston, MA (US)

(73) Assignee: AstenJohnson, Inc., Charleston, SC (US)

( * ) Notice: Subject to any disclaimer, the term of this patent is extended or adjusted under 35 U.S.C. 154(b) by 347 days.

(21) Appl. No.: 10/570,620

(22) PCT Filed: Dec. 22, 2003

(86) PCT No.: PCT/US03/41168

§ 371 (c)(1),
(2), (4) Date: Mar. 3, 2006

(87) PCT Pub. No.: WO2005/068715

PCT Pub. Date: Jul. 28, 2005

(65) Prior Publication Data

US 2006/0283569 A1 Dec. 21, 2006

(51) Int. Cl.
*D21F 1/00* (2006.01)
*D21F 1/48* (2006.01)
*D21F 1/52* (2006.01)

(52) U.S. Cl. ..... 162/300; 162/301; 162/352; 162/363; 162/364

(58) Field of Classification Search ..... 162/203, 162/300, 301, 303, 304, 351, 352, 363, 364, 162/374

See application file for complete search history.

(56) References Cited

U.S. PATENT DOCUMENTS 3,232,825 A 2/1966 Robinson
3,438,854 A 4/1969 Means
4,532,008 A 7/1985 Creagan et al.
4,623,429 A * 11/1986 Tissari ..... 162/300
4,744,866 A * 5/1988 Koponen et al. ..... 162/203
4,908,102 A 3/1990 Zag et al.
5,034,098 A * 7/1991 Hergert ..... 162/203
5,074,996 A 12/1991 Galanty et al.
5,389,206 A 2/1995 Buck et al.

(Continued)

FOREIGN PATENT DOCUMENTS

CA 2118143 4/1995

(Continued)

*Primary Examiner*—Eric Hug
(74) *Attorney, Agent, or Firm*—Volpe and Koenig, P.C.

(57) ABSTRACT

A twin fabric hybrid forming section for paper making machine is described in which: the pitch of the fabric support elements decreases progressively in the machine direction; the level of vacuum applied to the forming fabrics through the dewatering boxes increases in the machine direction; the two forming fabrics together with the stock sandwiched between them traverse at least four separate and distinct vacuum zones within the forming section as they proceed in the machine direction; the level of vacuum applied to the last of the at least four separate and distinct vacuum zones is higher than the level of vacuum applied to the first of the separate and distinct vacuum zones; the level of vacuum applied to the at least four separate and distinct vacuum zones follows a preselected profile; and the dewatering boxes carrying the fabric support elements are arranged so that the fabric support elements are located in an alternating sequence on the machine sides of both of the forming fabrics.

14 Claims, 4 Drawing Sheets

U.S. PATENT DOCUMENTS 5,489,365 A 2/1996 Wahlstrom
5,500,091 A 3/1996 Buck et al.
5,593,546 A 1/1997 Ilvespaa et al.
5,599,427 A 2/1997 Koivuranta et al.
5,607,555 A 3/1997 Grossmann et al.
5,635,032 A * 6/1997 Bubik et al. ..... 162/301
5,635,033 A 6/1997 Grossmann et al.
5,647,958 A 7/1997 Schmidt-Rohr et al.
5,656,133 A 8/1997 Savia
5,718,805 A 2/1998 Egelhof et al.
5,730,841 A 3/1998 Wanke
5,766,419 A 6/1998 Linsuri et al.
5,798,024 A 8/1998 Odell et al.
5,833,809 A 11/1998 Odell
6,669,820 B2 12/2003 Odell

FOREIGN PATENT DOCUMENTS

EP 0 296 135 12/1988
EP 0 688 900 12/1995

* cited by examiner

HYBRID TYPE FORMING SECTION FOR A PAPER MAKING MACHINE

BACKGROUND

This invention relates to a twin fabric hybrid forming section for use in a paper making machine. In a hybrid forming section the stock jet is ejected from a headbox slice onto a first forming fabric that is travelling in a horizontal plane in the machine direction over a series of dewatering boxes comprising a conventional open surface single fabric forming section. A second forming fabric is then brought into intimate contact with the exposed upper sheet surface at the beginning of the hybrid two fabric forming section. The partially formed sheet and the undrained stock is sandwiched between two forming fabrics; drainage then occurs through both forming fabrics. The second forming fabric is separated from the upper surface of the formed sheet at the end of the hybrid two fabric forming section and the sheet is conveyed to the press section on the first forming fabric. This invention is concerned with that portion of the hybrid two fabric forming section between the locus at which the first and second forming fabrics come together to sandwich the stock between them and the locus at which the first and second forming fabrics separate with the sheet continuing on the first forming fabric. Although the forming section described here includes a single second forming fabric section this invention is not so limited. It is common to have more than one hybrid two fabric forming section, and to have a second headbox delivering a second layer of stock onto the first forming fabric ahead of the second hybrid two fabric forming section.

In a hybrid type forming section the two forming fabrics do not follow a linear path. The fabrics together pass over a sequence of rolls and dewatering boxes which are located on alternate sides of the two fabrics and thus define the sinuous path of the two fabrics. Each dewatering box has a curved surface, which carries a group of fabric support elements, such as blades, which are in contact with the machine sides of the forming fabrics. Each dewatering box may also be connected to a source of controlled vacuum. These curved surfaces cause the moving forming fabrics to follow the desired sinuous path. The application of a controlled level of vacuum to the dewatering boxes has two effects: it promotes the removal of water from the stock between the two moving forming fabrics, and it deflects the path of the two moving forming fabrics into the gaps between the fabric support elements. This deflection of the two moving forming fabrics generates a positive pressure pulse within the stock layer sandwiched between them that creates fluid movement within the stock in the machine direction; this causes a shearing action within the stock which serves to break up fibre flocs.

The actual magnitude of each pressure pulse generated by the deflection angle of the moving forming fabrics at the edges of each fabric support element has a significant impact on the quality of the final sheet produced. The strength of the pressure pulse generated by each fabric support element should be chosen to match the stock conditions and properties at that fabric support element. Hence, there exists a need to be able to modify the strength and/or magnitude of the pressure pulses as more water is drained from the stock and the incipient paper web is formed.

Poor control of the fabric deflection within the forming section has been found to have an adverse effect on the formation process, which will in turn have a negative impact on the quality of the paper product being made.

The actual fabric deflection angle at the edge of each fabric support element in an operating twin fabric forming section has been found to be controlled by several factors. These include:

1. the geometric layout of the physical components used in the construction of the forming zone; including the element-to-element pitch for the fabric support elements, the machine direction width of the fabric support elements, and the radius of curvature of the surfaces to which the fabric support elements are attached;

2. the level of vacuum applied to the dewatering boxes which controls the degree to which the moving forming fabrics are deflected into the gaps between the fabric support elements; and 3. the amount of machine direction tension applied to each of the two moving forming fabrics.

As used herein, then following terms are to be taken to have the following meanings:

(i) the term machine direction, or MD, refers to a direction generally parallel to the direction of movement of the forming fabrics away from a headbox slice;

(ii) the term "pitch" refers to the centre to centre spacing of successive fabric support elements in the machine direction; and (iii) the terms "fabric support element" and "fabric support elements" refer:

either to moving surfaces such as rolls over which a forming fabric moves in rolling contact, or to static surfaces such as blades, foils or the like over which a forming fabric moves in sliding contact.

In the initial stages of sheet formation, when the level of vacuum applied to the machine side of the forming fabric, and consequently to the incipient paper web, is low, the predominant factors controlling forming fabric deflection are the geometry of the forming section and the tension applied to both of the forming fabrics. Further, although the tension applied to the two forming fabrics is usually the same, two different tension levels can be used. The two tensions are set, within the overall pattern of adjustments, to obtain the desired level of pressure pulses within the stock sandwiched between the two moving forming fabrics.

From the point at which the stock is first sandwiched between the two moving forming fabrics until the point at which the two forming fabrics separate, the consistency of the stock is continually increasing as water is drained from the incipient paper web. At the same time as the stock consistency increases, there is also a corresponding decrease in individual fiber mobility within the stock. These changes require a stronger pressure pulse to provide beneficial fiber movement which will improve the sheet properties in the incipient paper web. However, the incipient paper web eventually reaches a consistency at which no further beneficial fiber movement can occur. From that point onwards until the two moving forming fabrics separate the pressure pulse strength must be controlled by careful selection of the required vacuum level so that drainage continues, and by careful selection of the radius, fabric support element pitch and fabric support element width so that the pressure pulse strength is controlled to a level which will not act to impair formation of the incipient paper web.

During the initial sheet forming period where beneficial fiber movement can still occur, the need for a larger pressure pulse may increase at a faster rate than can be achieved by control of the vacuum level applied to the forming fabrics alone. This is because the vacuum level must be limited to a value which does not cause excessive drainage which will both reduce fiber mobility and set the sheet properties before the desired formation benefits can be achieved. It is therefore essential to obtain a larger pressure pulse by causing a higher deflection of the forming fabrics at the edges of the fabric support elements by utilizing a wider pitch between them and/or by utilizing a higher radius of curvature in the structure to which the fabric contacting fabric support elements are attached, and/or by utilizing opposed fabric support elements, such as blades, located to increase fabric deflection into the gaps between the fabric support elements.

SUMMARY

It is thus apparent that there is a matrix of variables which must be considered in order to optimise the quality of the sheet product. The present invention is based on the realization that the following factors must to be taken into account in the creation of an improved twin fabric hybrid type forming section for paper making machine:

(a) the pitch of the fabric support elements should decrease progressively in the machine direction;

(b) the level of vacuum applied to the forming fabrics through the dewatering boxes should increase in the machine direction;

(c) the two forming fabrics together with the stock sandwiched between them should traverse at least four separate and distinct vacuum zones within the forming section as they proceed in the machine direction;

(d) the level of vacuum applied to the last of the at least four separate and distinct vacuum zones must be higher than the level of vacuum applied to the first of the separate and distinct vacuum zones;

(e) the level of vacuum applied to the at least four separate and distinct vacuum zones must follow a preselected profile; and (f) the dewatering boxes carrying the fabric support elements should be arranged so that the fabric support elements are located in an alternating sequence on the machine sides of both of the forming fabrics.

Thus in a first broad embodiment this invention seeks to provide a two fabric hybrid type forming section for a paper making machine having a first forming fabric and at least one second forming fabric, such that:

(i) each of the forming fabrics has a paper side and a machine side;

(ii) the forming fabrics move together in close proximity with each other in the machine direction with a layer of stock sandwiched in between;

(iii) the forming fabrics are supported by a series of rolls and/or a series of static fabric contacting fabric support elements over which the machine sides of each of the forming fabrics pass in sliding contact, the fabric support elements being supported on a sequence of dewatering boxes, the dewatering boxes each having a curved fabric support element supporting surface; and (iv) the dewatering boxes provide separate drainage zones at least some of which are connected to a source of vacuum to provide separate vacuum zones, wherein:

(a) the forming zone comprises that portion of the forming section between the locus at which the forming fabrics come together to sandwich the stock between them and the locus at which the two forming fabrics separate with the stock continuing on one of them;

(b) the dewatering boxes provide at least four separate and distinct vacuum zones within the forming section;

(c) either: the radii of curvature of the curved surfaces located over those dewatering boxes which are connected to a source of vacuum supporting the fabric supporting elements decreases progressively in the machine direction, or: the radii of curvature of the curved surfaces located over those dewatering boxes which are connected to a source of vacuum supporting the fabric support elements decreases on successive support surfaces in the machine direction;

(d) either: the pitch of the fabric support elements within each vacuum zone is constant, and the pitch of the fabric support elements on successive vacuum zones decreases in the machine direction;

or: the pitch of successive fabric support elements within each vacuum zone decreases in the machine direction.

(e) the dewatering boxes supporting the fabric support elements are constructed and arranged to locate the fabric support elements in contact with the machine sides of the first forming fabric and the second forming fabric in an alternating sequence in the machine direction;

(f) on all of the dewatering boxes:

either: all of the fabric support elements are the same width in the machine direction;

or: all of the fabric support elements are not the same width in the machine direction.

Preferably, the fabric support element pitch within each vacuum zone is constant, and the fabric support element pitch within successive vacuum zones decreases in the machine direction. Alternatively, the fabric support element pitch within each vacuum zone is not constant, and the fabric support element pitch within each successive vacuum zone decreases in the machine direction.

Preferably, the radii of curvature of the curved surfaces supporting the fabric support elements on successive vacuum zones decreases in the machine direction. Alternatively, the radii of curvature of the curved surfaces supporting the fabric support elements on successive vacuum zones decrease progressively in the machine direction.

Preferably, each dewatering box provides at least one vacuum zone. More preferably, at least one dewatering box provides at least two vacuum zones. Most preferably all of the dewatering boxes provide more than one vacuum zone.

Preferably, the ratio of the width of the fabric support elements to the width of the gap between them varies from about 1:10 down to about 1:0.5.

BRIEF DESCRIPTION OF THE DRAWINGS

The invention will now be described with reference to the attached figures in which.

DETAILED DESCRIPTION OF THE PREFERRED EMBODIMENTS

Figure 1:
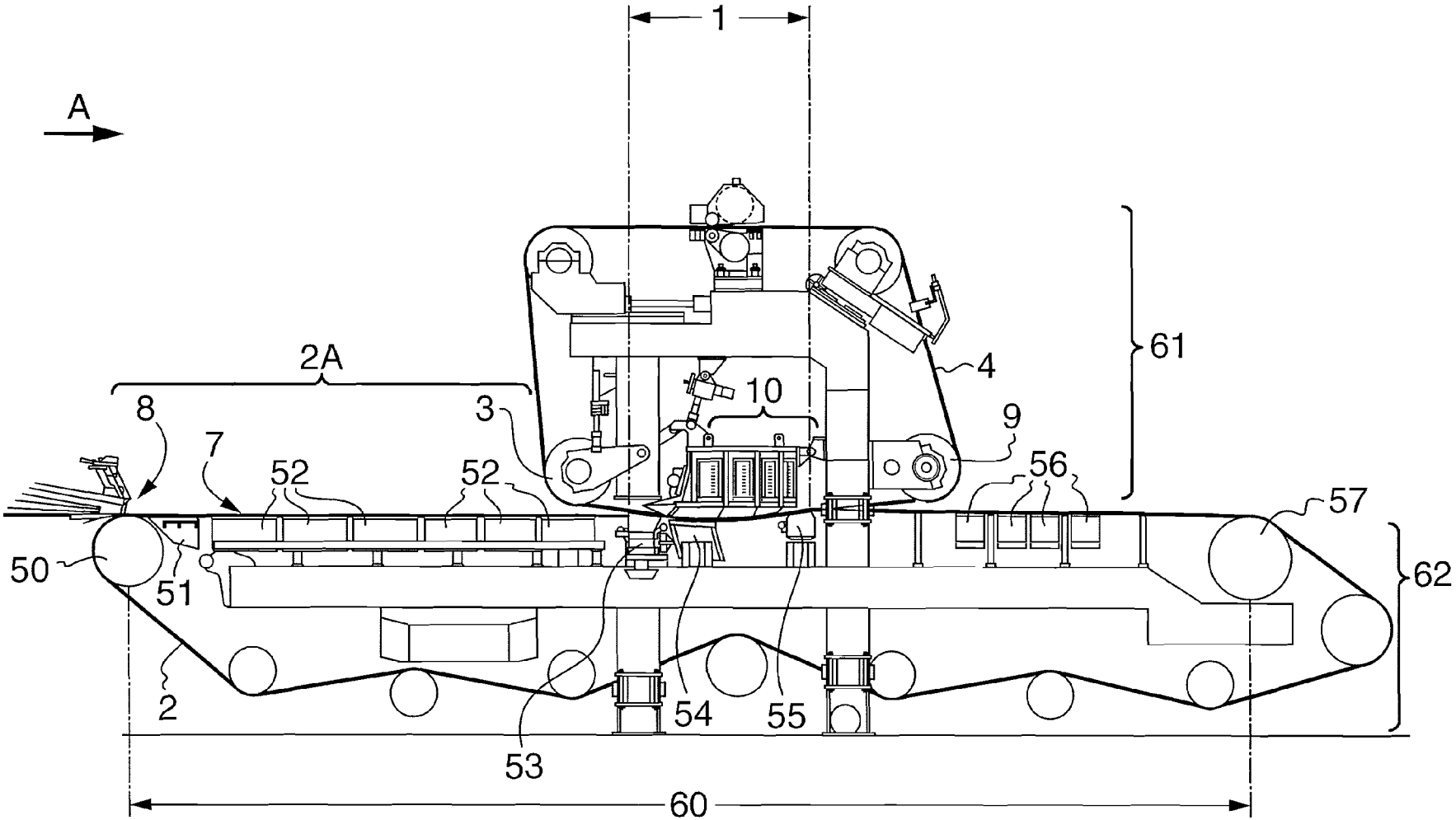
FIG. 1 shows schematically a two fabric hybrid type forming section according to first embodiment of the invention.

Referring first to FIG. 1, a two fabric hybrid type forming section 1 is shown. The forming section 1 is arranged substantially horizontally; the arrow A indicates the horizontal direction.

In the forming section of this invention, the formation zone 60 where the sheet is formed on the first forming fabric 2 extends from the breast roll 50 to the couch roll 57. A layer of stock 7 is ejected from the headbox slice 8 onto the first forming fabric 2. Within this zone 60 the two fabric hybrid forming section extends from the locus where the first forming fabric 2 carrying the layer of stock 7 contacts the second forming fabric 4 at lead-in box 53 sandwiching the stock 7 between them, to the locus of the turning roll 9 and transfer box 55 where the first and second forming fabrics separate. The sheet continues towards the press section on the first forming fabric 2. The two forming fabrics move together through the hybrid forming section 1 so that the sheet moves in the machine direction as indicated by arrow A.

Although the hybrid forming section 1 shown in FIG. 1 includes a single so-called "top wire" forming unit 61, located on the first forming fabric 2, other arrangements are possible. For example more than one own headbox delivering additional stock onto the first forming fabric 2. Each additional unit 61 can also be provided with its own headbox delivering additional stock onto the first forming fabric 2.

In the operation of the formation zone 60, a jet of stock is ejected from the headbox slice 8 to provide a layer 7 of very aqueous stock on the open surface portion 2A of the first forming fabric 2. The first forming fabric 2 and the stock layer 7 move together in the machine direction shown by arrow A, over in sequence a forming board 51, and a series of dewatering boxes and other sundry dewatering devices indicated generally as 52. The first forming fabric 2 carrying the stock layer 7 then enters the top wire unit 61 of the hybrid forming section 1. The second forming fabric 4 is brought into contact with the stock layer 7 at this point, so that it becomes sandwiched between the first and second forming fabrics 2 and 4 (see FIG. 2 for more details). The first forming fabric 2 and the second forming fabric 4, with the stock layer 7 sandwiched between them, then pass with their respective machine sides in contact with a sequence of units. These are: a lead-in dewatering box 53, a multi-chambered dewatering box 10, an opposed fabric support element unit 54 and a transfer box 55. The multi-chambered dewatering box 10 is located with its fabric support elements in contact with the machine side of the second forming fabric only (see FIGS. 2, 3 and 4). At the end of the unit 61 the second forming fabric 4 wraps around a turning roll 9 and is thereby taken out of contact with the stock layer 7. The stock layer 7 carried by the first forming fabric 2 then passes over further dewatering boxes 56 and finally is transferred after the couch roll 57 at the end of the forming section 61 to the press section (not shown) for further processing.

Figure 2:
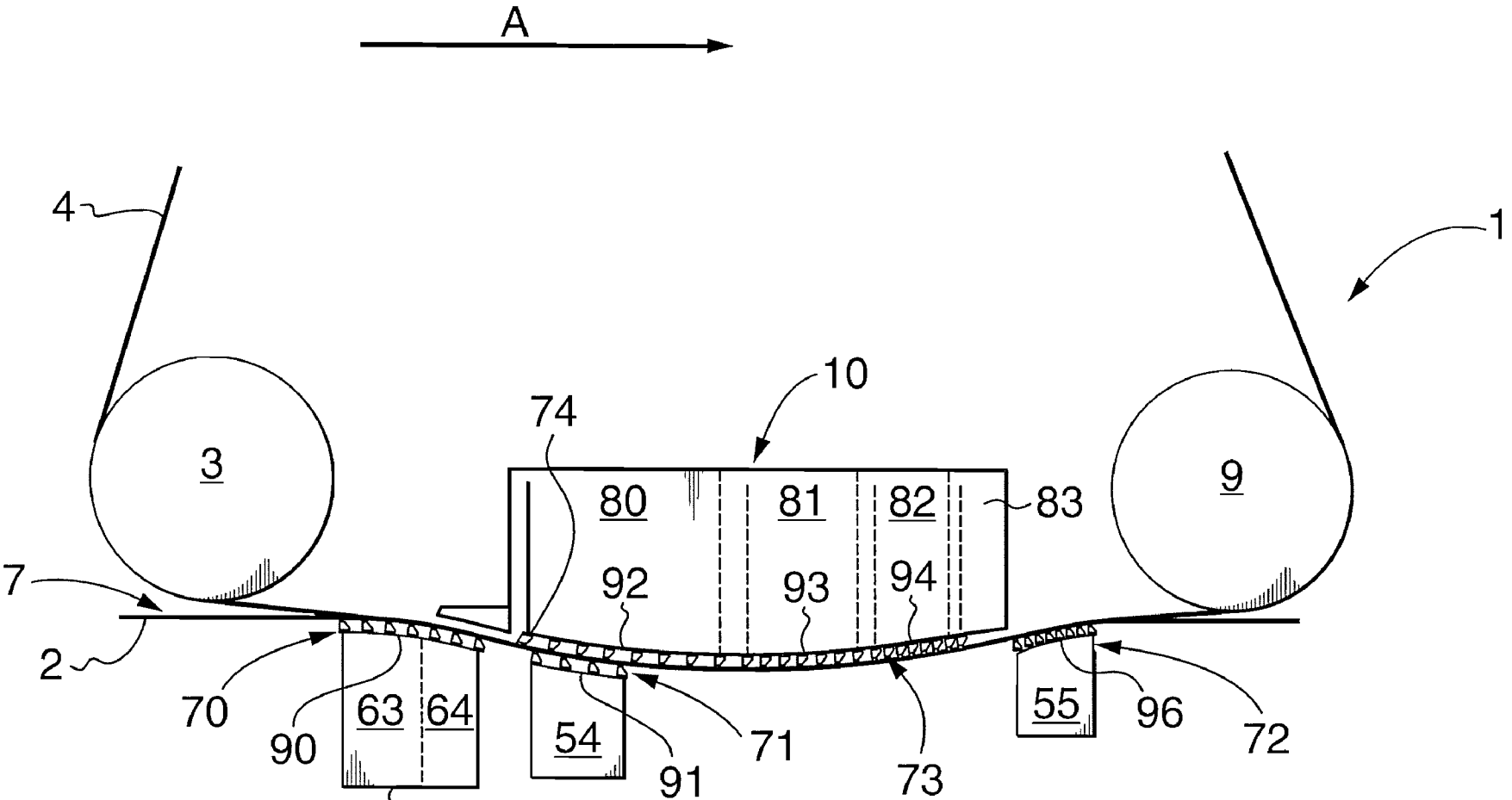
FIG. 2 shows schematically in more detail the hybrid forming zone of FIG. 1.

FIG. 2 shows a more detailed schematic view of the lower part of the two fabric hybrid forming section 1 shown in FIG. 1. In FIG. 2 the second forming fabric 4 partially wraps around the forming roll 3 with the result that the stock 7, which is conveyed in the machine direction as indicated by the arrow A, becomes sandwiched between the first forming fabric 2 and the second forming fabric 4. The two forming fabrics 2 and 4 with the stock layer 7 sandwiched between them then pass over several dewatering devices. The machine side of the first forming fabric 2 passes in sliding contact over the lead-in dewatering box 53, an opposed fabric support element box 54 and a transfer box 55. At the same time, the machine side of the second forming fabric 4 passes in sliding contact with the opposed fabric support elements 73 located on the multi-chambered dewatering unit 10. Box 54 is optional, and the support elements 71 need not all be in contact with the machine side of the fabric 2. The two forming fabrics 2 and 4 thus pass together in sequence past these four dewatering units in the sequence box 53, unit 54, unit 10 and box 55. After box 55 the second forming fabric 4 wraps around the turning roll 9 and is carried away out of contact with the stock 7. The stock 7 is carried by the first forming fabric 2 towards the press section (not shown).

Figure 4:
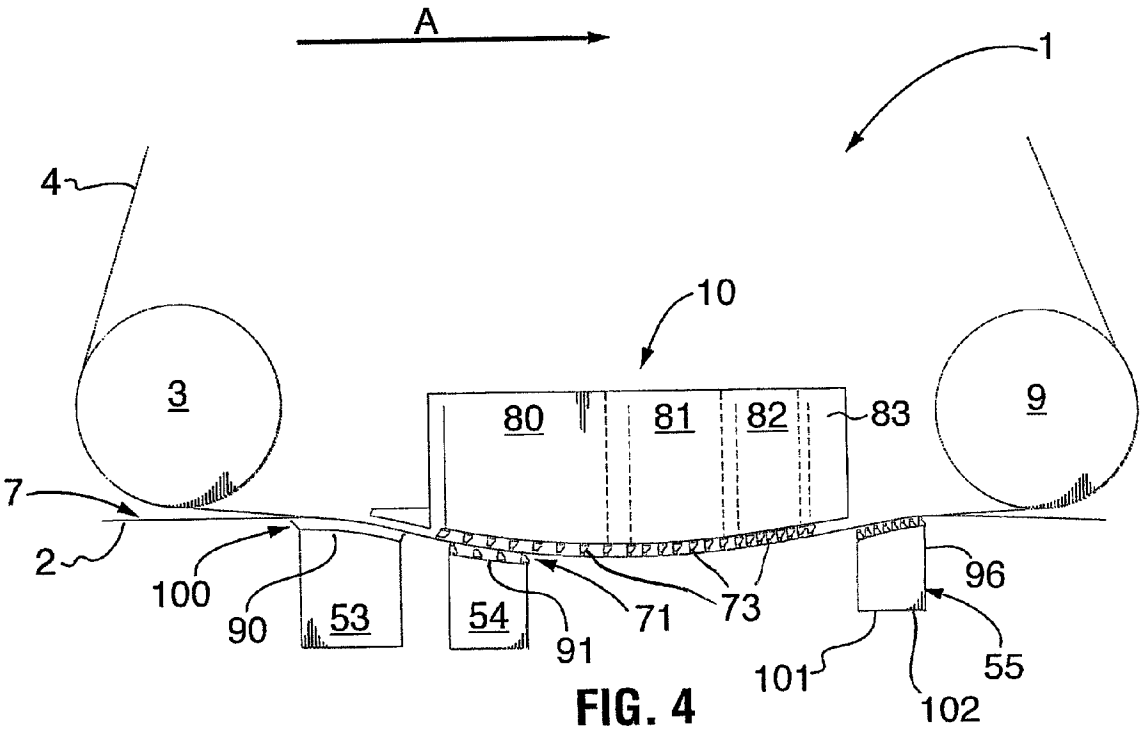
FIG. 4 shows schematically a further alternative construction to that shown in FIG. 1.

In FIG. 2, dewatering box 53, which is referred to as a lead-in box, as shown is provided with two vacuum chambers 63, 64. Box 55, which is referred to as a transfer box, which ensures the transfer of the stock 7 from the second forming fabric 4 to the first forming fabric 2, as shown is provided with a single vacuum chamber. Either or both of these dewatering boxes 53 and 55 may be internally divided to provide two, or more, separate vacuum chambers each of which is connected to a separate controlled vacuum supply (not shown). A further embodiment is shown in FIG. 4, in which Box 53 comprises a single vacuum chamber and Box 55 comprises two vacuum chambers 101, 102.

In Box 53, forming fabric support elements 70 are mounted on the continuously curved fabric support element supporting surface 90. Box 54 is an opposed fabric support element unit, which is a gravity drainage box. Water removed from the machine side surface of the first forming fabric 2 drops into the box 54, and is removed therefrom. The box 54 includes fabric support elements 71, which are mounted on the surface 91. As this box 54 is on the outside of the convex curve of the two fabrics 2, 4, formed by the box 10, the fabric support elements 71 can be mounted on flexible, adjustable mountings such as those disclosed by McPherson in U.S. Pat. No. 6,361,657. Box 55 is provided with a plurality of fabric support elements 72 supported by the continuously curved surface 96.

FIG. 2 also shows a multi-chambered dewatering unit 10. As shown, unit 10 includes four distinct vacuum zones 80, 81, 82 and 83, each of which is provided with a separate controlled vacuum supply (not shown). Located beneath each of the separate vacuum zones 80, 81, and 82 is a set of fabric support elements, as at 73. The fabric support elements 73 are supported on the curved surfaces 92, 93 and 94.

There are several possibilities for the radii of curvature of the three surfaces 92, 93 and 94.

(i) The three radii of curvature can be the same, so that all three surfaces 92, 93 and 94 together form a single constant radius curve.

(ii) At least one of the three radii can be different, or all three can be different. If this arrangement is adopted, then the radius of curvature of each of the surfaces 92, 93 and 94 must decrease in the machine direction, so that the radius of curvature of the surface 94 is always the smallest of the three.

It also apparent from FIG. 2 that the pitch of the fabric support elements 73 on the multi-chambered dewatering unit 10 is not constant. The pitch decreases in the machine direction.

In FIG. 2, fabric support element 74 which is the first element of the set 73, is located on the upstream side of zone 80 towards the headbox slice and is a so-called autoslice blade, also known as a skimmer blade. When in use, the autoslice blade 74 skims excess water from the machine side of the second forming fabric 4 as it passes in the machine direction in sliding contact with the element 74.

Figure 3:
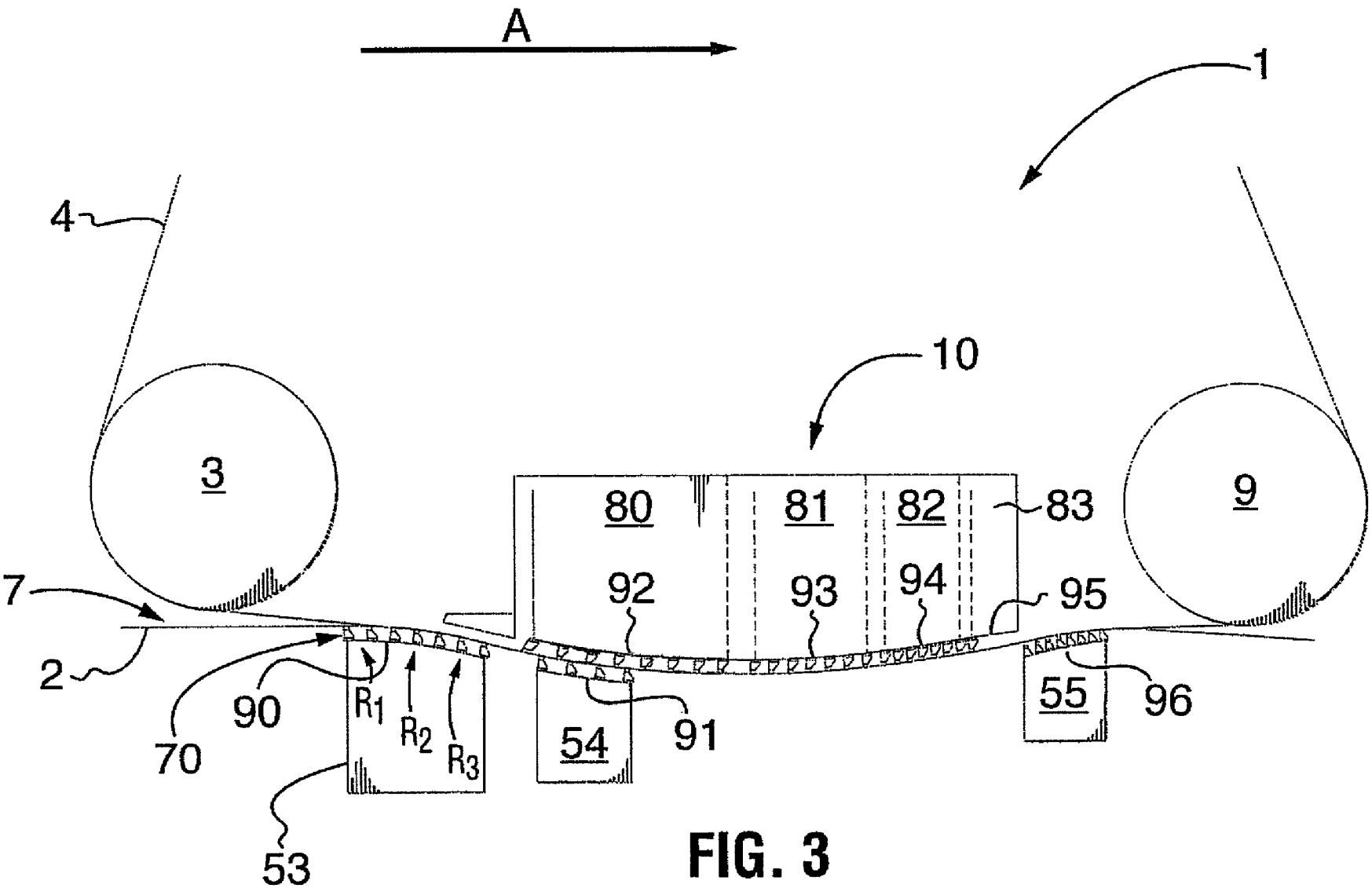
FIG. 3 shows schematically an alternative construction to FIG. 2.

FIG. 3 is similar to FIG. 2, with the exception that on box 53 the radius of curvature of the curved fabric support element supporting surface 90 is not constant. The surface 90 is broken into successive portions having radii of curvature $R_1$, $R_2$ and $R_3$. The radius of curvature for each portion decreases in the machine direction, so that $R_1$ is the largest radius of curvature. By decreasing the radius of curvature of the supporting surface 90 for the fabric support elements 70 located on the lead-in box 53 so as to increase sequentially the amount of wrap of the first and second forming fabrics 2,4 the stock 7 is subjected to increasingly stronger pressure pulses, which induce shearing actions within the stock 7, at each edge of the fabric support elements 70 as the forming fabrics 2,4 pass over them in the machine direction. This feature is also shown in each of the dewatering boxes 53, 54, 10 and 55.

FIG. 4 is also similar to FIG. 2 except that the individual or discrete fabric support elements 70 of the lead-in box 53 are replaced by the continuous curved surface 100 mounted on support surface 90, as described by Buchanan et al. in US 2003/017438. In addition, the transfer box 55 has been internally portioned to provide two separate vacuum zones 101 and 102, each of which is provided with its own controlled vacuum supply (not shown).

In the drawings the fabric support elements are all shown schematically to have the same width in the machine direction. In practise, the fabric support element width may not be the same for all of the dewatering boxes. Some dewatering boxes may require a different width fabric support element just to accommodate the volume of white water which is being drained from the forming fabrics at that location. It is also possible that a different width fabric support element may be required in order to obtain the desired level of pressure pulse within the stock at a given location. Experience shows that the ratio of the machine direction width of fabric support elements to the width of the gap between them should be from about 1:10 to about 1:0.5.

In the drawings dewatering boxes are shown which have more than one chamber to each of which a controlled level of vacuum is applied. If the vacuum levels in adjacent chambers or dewatering boxes are not the same, it is desirable that the surface curvatures, and possibly also the corresponding fabric support element pitch, also should not be the same. Furthermore experience shows that it is desirable that the vacuum level in a sequence of dewatering boxes or chambers should increase relatively smoothly in the machine direction. Although the vacuum level can remain constant in two adjacent dewatering boxes or chambers it should not decrease in the machine direction, and furthermore spikes of radically different pressure should be avoided. In other words, all of the variables do not necessarily change smoothly in a step wise fashion; adjacent zones can have the same values for at least some of the variables.

The invention claimed is:

1. A two fabric hybrid type forming section for a paper making machine having a first forming fabric and at least one second forming fabric, such that:

(i) each of the forming fabrics has a paper side and a machine side;

(ii) the first forming fabric receives a layer of stock at an impingement point in a first open surface region, and thereafter passes in sequence through the first open surface region, a central forming zone and a second open surface region;

(iii) the second forming fabric passes through the central forming zone such that the paper side of the second forming fabric faces the paper side of the first forming fabric, and the two forming fabrics move together in the machine direction with a layer of stock sandwiched in between;

(iv) the forming fabrics are supported by a series of fabric support elements, chosen from the group consisting of rolls, static fabric support elements and both rolls and static fabric support elements, over which the machine sides of each of the forming fabrics pass in sliding contact, the fabric support elements being supported on a sequence of dewatering boxes, the dewatering boxes having a curved fabric support element supporting surface; and (v) the dewatering boxes provide separate drainage zones and at least some of the dewatering boxes are connected to a source of vacuum to provide separate vacuum zones, wherein:

(a) the dewatering boxes provide at least four separate and distinct vacuum zones within the central forming zone;

(b) the radii of curvature of the curved surfaces supporting the fabric support elements decrease progressively in the machine direction;

(c) a pitch of the fabric support elements decreases progressively in the machine direction; and (d) the dewatering boxes supporting the fabric support elements are selectively located on the machine sides of the first forming fabric and the second forming fabric in opposed and at least partially offset sequence in the machine direction.

2. A forming section according to claim 1, wherein the pitch of successive fabric support elements within at least one vacuum zone decreases in the machine direction.

3. A forming section according to claim 1, wherein the fabric support elements have a width in the machine direction which decreases progressively in the machine direction.

4. A forming section according to claim 1, wherein the fabric support elements within at least one vacuum zone have a width in the machine direction which decreases progressively in the machine direction.

5. A forming section according to claim 1, wherein each dewatering box provides at least one vacuum zone.

6. A forming section according to claim 5, wherein at least one dewatering box provides at least two vacuum zones.

7. A forming section according to claim 6, wherein each dewatering box provides at least two vacuum zones.

8. A forming section according to claim 6, wherein in each dewatering box which provides at least two vacuum zones, the fabric support element pitch within successive vacuum zones provided by the dewatering box decreases in the machine direction.

9. A forming section according to claim 7, wherein in each dewatering box which provides at least two vacuum zones, the fabric support element pitch within successive vacuum zones provided by the dewatering box decreases in the machine direction.

10. A forming section according to claim 6, wherein in each dewatering box which provides at least two vacuum zones, the radii of curvature of the curved surfaces supporting the fabric support elements within successive vacuum zones provided by the dewatering box decreases in the machine direction.

11. A forming section according to claim 7, wherein in each dewatering box which provides at least two vacuum zones, the radii of curvature of the curved surfaces supporting the fabric support elements within successive vacuum zones provided by the dewatering box decreases in the machine direction.

12. A forming section according to claim 1, wherein the ratio of the width of the fabric support elements to the width of the gap between them varies from about 1:10 to about 1:0.5.

13. A forming section according to claim 1, wherein the forming section further includes a turning roll which is provided with vacuum assisted drainage.

14. A forming section according to claim 1, wherein the forming section further includes a turning roll without vacuum assisted drainage.

* * * * *

UNITED STATES PATENT AND TRADEMARK OFFICE

CERTIFICATE OF CORRECTION

PATENT NO. : 7,524,401 B2
APPLICATION NO. : 10/570620
DATED : April 28, 2009
INVENTOR(S) : Wildfong et al.

It is certified that error appears in the above-identified patent and that said Letters Patent is hereby corrected as shown below:

ON THE TITLE PAGE

At Item (75), line 2, after the word "Pitt", delete "Almonte" and insert therefor --Almonte, ON--.

IN THE SPECIFICATION

Figure 4A:
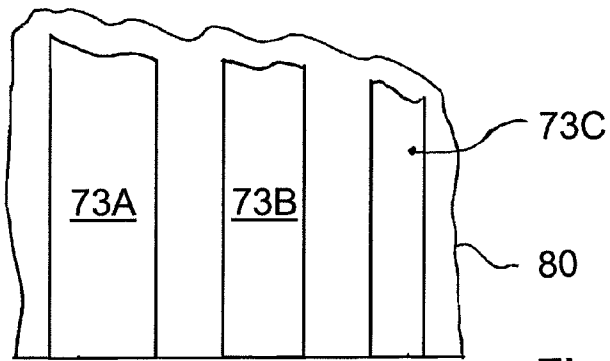

At column 4, line 54-55, delete "FIG. 4 shows schematically a further alternative construction" and insert therefor --FIGS. 4 and 4A show schematically further alternative constructions--.

At column 5, line 5, after the word "roll", delete "9" and insert therefor --9, which can optionally be provided with vacuum assisted drainage,--.

At column 6, Line 59, after the word "not", delete "constant" and insert therefor --constant, and the pitch of the fabric support element, which is shown in Fig. 2 as decreasing in consecutive boxes in the machine direction 10, is shown in Fig. 3 as decreasing within a specific vacuum zone, i.e. on the surface 92 for zone 80.--.

At column 7, line 12, after "(not shown)." , insert the following sentence --As shown in Fig. 4A, which shows an alternate configuration for a portion of the dewatering zone 80, the width of the fabric support elements 73A, 73B, 73C can decrease within a specific vacuum zone.--.

UNITED STATES PATENT AND TRADEMARK OFFICE

CERTIFICATE OF CORRECTION

PATENT NO. : 7,524,401 B2
APPLICATION NO. : 10/570620
DATED : April 28, 2009
INVENTOR(S) : Wildfong et al.

It is certified that error appears in the above-identified patent and that said Letters Patent is hereby corrected as shown below:

At column 7, line 13, delete "In" and insert therefor --Expect as indicated in Figure 4A, in--.

Signed and Sealed this

Twenty-seventh Day of October, 2009

David J. Kappos

David J. Kappos
*Director of the United States Patent and Trademark Office*